US005933703A

United States Patent [19]

Robertson

[11] Patent Number: 5,933,703

[45] Date of Patent: Aug. 3, 1999

[54] PROCESS FOR THE PREPARATION OF FIBRE REINFORCED METAL MATRIX COMPOSITES AND NOVEL PREFORMS THEREFOR

[75] Inventor: James Garfield Robertson, Kingston-on-Thames, United Kingdom

[73] Assignee: The Secretary of State for Defence in Her Britannic Majesty's Government of the United Kingdom of Great Britain and Northern Ireland, Hampshire, United Kingdom

[21] Appl. No.: 08/972,366

[22] Filed: Nov. 18, 1997

Related U.S. Application Data

[63] Continuation of application No. 08/689,495, Aug. 7, 1996, abandoned, is a continuation of application No. 07/968,606, Oct. 29, 1992, Pat. No. 5,675,837.

[30] Foreign Application Priority Data

Oct. 29, 1991 [GB] United Kingdom ..... 9122913

[51] Int. Cl.[6] ..... B22F 1/00; B22F 5/00

[52] U.S. Cl. ..... 428/549; 428/551; 428/567; 428/568; 428/607; 428/608

[58] Field of Search ..... 428/539.5, 549, 428/551, 567, 568, 606, 607, 608

[56] References Cited

U.S. PATENT DOCUMENTS

| | | | |
|---|---|---|---|
| 3,293,072 | 12/1966 | Doolittle et al. | 117/138.8 |
| 3,432,295 | 3/1969 | Frank et al. | 75/206 |
| 3,450,510 | 6/1969 | Calow | 29/182.2 |
| 3,464,845 | 9/1969 | Osborn et al. | 117/49 |
| 4,010,884 | 3/1977 | Rothman | 228/190 |
| 4,060,413 | 11/1977 | Mazzei et al. | 75/208 R |
| 4,867,644 | 9/1989 | Wright et al. | 416/230 |
| 4,871,621 | 10/1989 | Bagley et al. | 428/549 |
| 5,162,157 | 11/1992 | Tanaka et al. | 428/549 |
| 5,326,525 | 7/1994 | Ghosh | 419/23 |

*Primary Examiner*—Kathryn Gorgos
*Assistant Examiner*—Chrisman D. Carroll
*Attorney, Agent, or Firm*—Nixon & Vanderhye P.C.

[57] ABSTRACT

A process for the preparation of a fiber reinforced metal matrix composite comprising fibers embedded in a metal in which the process comprises forming a body with a layer of aligned fibers between at least two layers of metal foil and densifying said layers wherein the layer of aligned fibers comprises metal particles interposed between individual fibers, the metal particles being compatible with the metal foil. A preform for a fiber reinforced metal matrix composite is also claimed which comprises a resin and a layer of aligned fibers, the layer having metal particles interposed between adjacent fibers and the layer and particles being bonded together with the resin.

11 Claims, 1 Drawing Sheet

PROCESS FOR THE PREPARATION OF FIBRE REINFORCED METAL MATRIX COMPOSITES AND NOVEL PREFORMS THEREFOR

This is a continuation of application Ser. No. 08/689,495, filed Aug. 7, 1996, now abandoned; which is a division of application Ser. No. 07/968,606, filed Oct. 29, 1992, now U.S. Pat. No. 5,675,837.

BACKGROUND OF THE INVENTION

1. Field of the Invention

The present invention relates to a process for the preparation of fibre reinforced metal matrix composites and novel preforms therefor.

2. Discussion of the Prior Art

A composite is a material which consists of fibres in a common matrix. The mechanical properties of the composite depend upon many factors which include the orientation of the fibres within the composite body.

Composites may be prepared by interposing layers of fibres between layers of metal and densifying the resulting body. The layer of fibres may comprise a number of aligned continuous fibres. With such arrangements it has been found that where adjacent fibres are touching, or nearly touching, a weakness can occur in the final composite body. It is therefore of great advantage to have a process for preparing a reinforced fibre metal matrix composite where fibre/fibre contact is kept to a minimum.

A known method for the preparation of fibre reinforced metal matrix composites involves aligning the fibres and spraying the fibres with a binder material to prevent the fibres moving during the lay-up procedure. Prior to densification, the binder material must be removed and during this stage fibre movement is known to occur.

Alternatively, the fibres may be held together by weaving with a fine metal wire or ribbon to produce a mat-like structure. The fibres are then placed between layers of metal. This particular method can result in fibre damage and the resulting distribution and volume fraction is often less than desirable.

Also known is a method where the matrix metal is plasma sprayed onto a bed of aligned fibres. This method is disclosed in GB-A-2239262. Problems encountered with this method include matrix contamination, limited availability of suitable matrix materials and the requirement of high capital investment.

DESCRIPTION OF THE INVENTION

We have now discovered a process for preparing fibre reinforced metal matrix composites wherein movement of the fibres is restricted during the process and fibre—fibre contact is kept to a minimum by interposing metal particles between the individual fibres.

Accordingly, the present invention provides a process for the preparation of a fibre reinforced metal matrix composite comprising fibres embedded in a metal, said process comprising forming a body with a layer of aligned fibres between at least two layers of metal foil and densifying said layers, characterised in that the layer of aligned fibres comprises metal particles interposed between individual fibres, said metal particles being compatible with the metal foil.

The present invention provides a process for preparing metal matrix composites wherein fibre—fibre interaction is substantially avoided. The invention provides the advantage over known prior art methods in that the fibres are kept in the desired distribution throughout the process, fibre movement and fibre contact being restricted during all stages.

The metal particles are compatible with the metal foil such that on densification there is little or no discontinuity between the particles and the foil. Typically, a homogeneous phase is formed where the metal particles and the metal foil are of the same metal or alloy eg titanium or a titanium alloy.

The layer of metal foil may be of any suitable thickness. Suitably, the layer is of similar thickness to the layer of fibres. Suitably, the layer of metal foil is from 50–200 microns thick, preferably 75–150 microns thick. The metal may suitably be titanium, aluminium or titanium aluminide or alloys thereof. Preferably, the metal is an alloy of titanium, for example, titanium/aluminium/vanadium.

The fibres used in the process of the present invention are suitably ceramic fibres. Suitably carbon, boron, alumina, boron carbide or silicon carbide fibres may be used in the process. Such fibres are well known and their manufacture is described in many publications which include U.S. Pat. No. 4,127,659 and U.S. Pat. No. 3,622,369.

The fibres may suitably have a diameter of from 50–250 microns, preferably 75–175 microns. Suitably, the fibre content of the composite may be from 20–60%, preferably 30–50% by volume of the composite.

Of the total ingredients to make the composite, there is preferably a low volume fraction of particles. Suitably, the particles are present from 0.1 to 5% by weight of the total particles, foil and fibres used to prepare final composite, preferably 0.5 to 4.0% by weight, especially 1 to 3.0% by weight. Suitably, the particles provide from 0.5 to 20%, preferably 2 to 10% by weight of the fibres in the layer.

The fibres within the layer are suitably aligned in an essentially parallel arrangement. This may be achieved during the preparation of the body by winding the fibre around a drum such that the neighbouring fibres are kept apart, e.g. helically. A single layer of fibres may be obtained. The fibre may be applied to a release paper mounted on the drum. It will of course be understood that the distance between two adjacent fibres will be dependant upon fibre size and fibre content in the composite. Suitably, the distance between two adjacent fibres may be from 5–200 microns, preferably 20–150 microns, especially 50–100 microns.

The particles may be of any shape and may be regular or irregular. The particles are accommodated within the space between two adjacent fibres. It is preferred that the particle diameter is equivalent to or less than the distance between two adjacent fibres. The particles may be regular or irregular in shape. During the preparation of the body, adjacent fibres are prevented from touching in the fibre layer due to the presence of the metal particles and the binder which is discussed later. Fibre—fibre contact in the resulting composite after removal of the binder but prior to densification is prevented due to the presence of the metal particles. It is not essential, although it is preferred, that there is a uniform distribution of particles throughout the layer of fibres.

It is essential to the process of the present invention that the metal particles be compatible with the metal foil. It is preferred that as a result of densification, there is little or no discontinuity between the particles and the foil. Suitably, the metal particles are titanium, aluminium, titanium aluminide or alloys thereof. Preferably, the metal particles are titanium alloy particles.

The metal particles may be interposed between the individual fibres using any suitable method. Suitably, the aligned fibres e.g. mounted on the drum may be sprayed with a bonding agent containing the metal particles. Examples of suitable resin bonding agents are alkyl (alk)acrylate ester polymers wherein the alkyl group has 1–10 carbons such as butyl, isobutyl, amyl, hexyl or octyl and the (alk)acrylate denotes acrylate, and alkyl substituted acrylate, in particular wherein the alkyl group has 1–4 carbons such as methyl. The resin is usually dissolved in an organic solvent such as alcohol, ketone or ester. The fibres may be treated in this manner a number of times. Suitably, the fibres are sprayed at least twice. Where it is desired to apply the particles by spraying, the binder may suitably contain from 10 to 30% by weight of the powder particles and 90 to 70% resin.

The solvent is evaporated, e.g. at room temperature or by heating, to leave a resin impregnated body. The combined body of fibres, with particles interposed between them, and resin may then be separated from the drum, e.g. by longitudinally cutting the body to produce a sheet of resin bonded fibres with particles. This sheet provides another aspect of the present invention.

According to the present invention there is also provided a body, which is a preform for a fibre reinforced metal matrix composite, which comprises a resin and a layer of aligned fibres, said layer having metal particles interposed between adjacent fibres and said layer and particles being bonded together with said resin. The preform may suitably contain 5–40%, preferably 15–25% by weight of resin, suitably 50–90%, preferably 70–85% by weight of fibres and 1–15%, suitably 2–10% by weight of particles.

Suitably, the preform having a first and second face is contacted with the layers of metal foil by contacting one layer of foil with the first face of the preform and then contacting another layer of foil with the second face of the preform.

In a preferred process, the metal matrix composite is prepared by placing a single layer of fibres containing the metal particles between at least two layers of the metal foil as in the aforementioned preform.

Advantageously, a number of preforms comprising fibres are placed alternately with metal foil sheets to produce a multicomponent structure with externally facing metal foil sheets.

The structure is then densified under pressure to produce a metal matrix composite in which the fibres are substantially spaced from each other.

The details of the densification procedure per se without the resin or particles will be familiar to the person skilled in the art.

Where the fibres are treated with a binder/metal particle composition, it is preferred to remove the binding material prior to densification. Suitably, this may be carried out by methods well known to the person skilled in the art. Suitably, the layered body may be placed in a furnace and the binding material burned off, e.g. at 300–600° C.

The densification process may be carried out using any suitable method. Preferably the layered body is hot isostatically pressed, e.g. at 800–1000° C. under 50–200 MPa pressure.

BRIEF DESCRIPTION OF THE DRAWINGS

The invention will now be described in more detail with reference to the following examples.

DETAILED DESCRIPTION OF THE PREFERRED EMBODIMENTS

Figure 1:
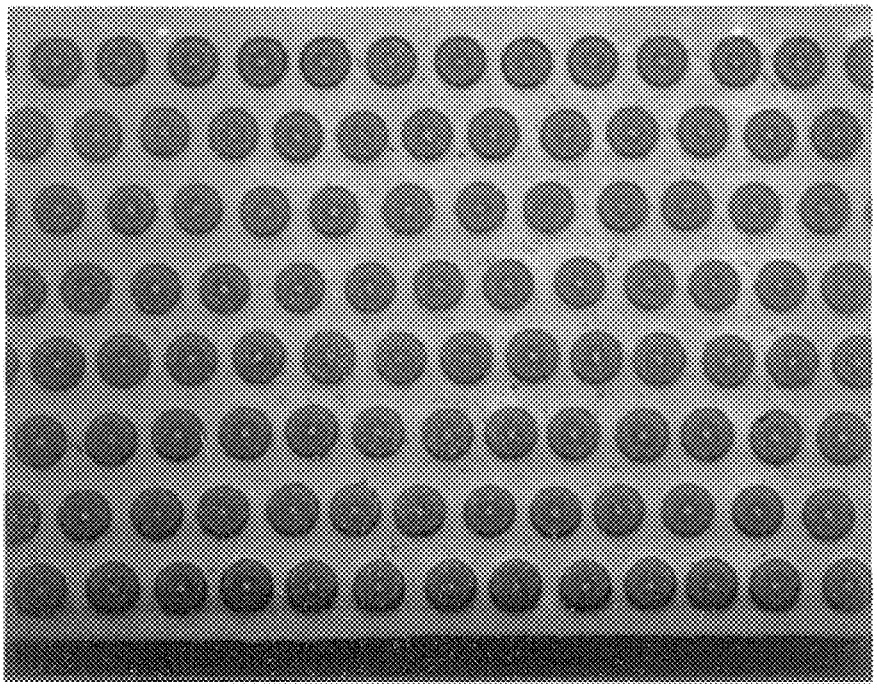
FIG. 1 is an optical micrograph of one embodiment of the present invention.

Preparation of Binding Composition 200 ml of methyl ethyl ketone was placed in a beaker. To this, 25% by volume (37 g) of an isobutyl methacrylate resin, sold under the Trademark Elvacite 2045, was added with stirring.

A titanium alloy powder (Ti-6Al-4V) (15 g) having an average particle diameter of 20 microns was then added to the solution with stirring.

EXAMPLE 1

A release paper was applied to a filament winding drum and secured with double sided adhesive tape. A silicon carbide monofilament of diameter 100 microns was carefully helically wound round the drum under tension of approximately 25 g to give a wound body with a single filament uniformly separated from the neighbouring filament by approximately 0.04 mm.

The resulting wound drum was coated with the binding composition, prepared according to the aforementioned procedure, using a gravity fed compressed air paint spraying gun. The binding composition was applied in three even coats to give a resulting thickness of approximately 150 microns. The drum was allowed to air dry for 15 minutes between each application of the coating.

Once dry, the coated body on the drum was cut longitudinally to give a sheet of preform body comprising fibres, particles, resin attached to release paper, which was removed from the drum, cut to a required size (300×300 mm), brushed clean to remove residues or debris and the release paper removed to leave a coated fibre preform body which contains a powder to fibre ratio of 1:17 and a resin to powder to fibre ratio of 4:1:17.

Similar size sheets of titanium alloy (Ti-6Al-4V) foil 100 microns thick were cut and immersed in a standard solution of hydrofluoric acid and nitric acid (4% HF, 30% $HNO_3$, 66% $H_2O$). The foils were removed from the solution, handled at the edge in order to avoid contamination.

In the first step of production of the composite alternate coated fibre preforms and titanium foils were laid up with a bottom and top surface of metal foil and the resulting product placed between two yttria coated steel plates. The composite weight ratios of the ingredients were 1.7 wt % powder, 69 wt % foil and 29.3 wt % fibre.

The lay-up was then placed in a steel can and the lid welded shut. The can was attached to a rotary/diffusion pump, placed in a furnance and degassed at above 400° C. for 12 hours.

The can was removed from the furnace, allowed to cool to room temperature and sealed using an electron beam welder. The can was then isostatically pressed at typically 900° C., 100 MPa for 1 hour.

The can was then opened, the composite body extracted and cleaned. FIG. 1 shows an optical micrograph of the polished section of the resulting composite. It is evident that the fibre distribution is uniform.

COMPARATIVE EXAMPLE 1

The procedure of Example 1 was repeated with the exception that the wound filament was sprayed with a composition comprising methyl ethyl ketone and the isobutyl methacrylate resin (Elvacite 2045). No titanium alloy powder was present in the composition.

Figure 2:
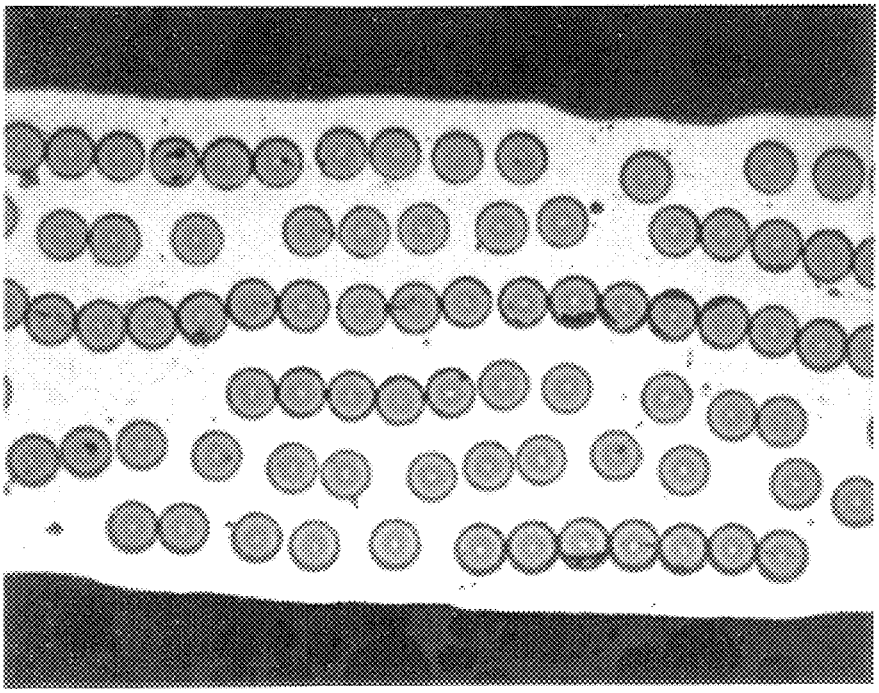
FIG. 2 is an optical micrograph of an embodiment without powder.

FIG. 2 shows the micrograph taken from the resulting composite. In this case, fibre distribution is irregular and uneven.

I claim:

1. A preform body for a fibre reinforced metal matrix composite which comprises a resin and a layer of aligned fibres, said layer having metal particles interposed between adjacent fibres and said layer and particles being bonded together with said resin, said layer containing 0.5–20 wt % metal particles by weight fibres.

2. A body according to claim 1 in which the distance between individual fibres is from 5 to 200 microns.

3. A body according to claim 1 in which the metal particles have a diameter no greater than the distance between adjacent fibres.

4. A body according to claim 1 in which the metal particles are interposed between individual fibres by spraying with a binding agent containing the metal particles.

5. A body according to claim 1 wherein:

(a) said fibres are selected from the group consisting of silicon carbide, boron carbide, carbon, boron and alumina; and (b) said metal particles are selected from the group consisting of titanium, aluminum, titanium aluminide and alloys thereof.

6. A preform body for a fibre reinforced metal matrix composite which comprises at least one layer of resin and aligned fibres, said layer having metal particles interposed between adjacent fibres; at least two layers of metal foil sandwiching said at least one layer of resin and aligned fibres, said at least two layers of metal foil and said aligned fibres and particles being bonded together with said resin.

7. A body according to claim 6 containing 0.5 to 20 wt % metal particles by weight of fibres.

8. A body according to claim 6 in which the distance between individual fibres is from 5 to 200 microns.

9. A body according to claim 6 in which the metal particles have a diameter no greater than the distance between adjacent fibres.

10. A body according to claim 6 in which the metal particles are interposed between individual fibres by spraying with a binding agent containing the metal particles.

11. A body according to claim 6 wherein:

(a) said fibres are selected from the group consisting of silicon carbide, boron carbide, carbon, boron and alumina; and (b) said metal particles are selected from the group consisting of titanium, aluminum, titanium aluminide and alloys thereof.

* * * * *